United States Patent [19]

Klaus

[11] 4,120,618

[45] Oct. 17, 1978

[54] PERMANENT MAGNETIC CENTRIFUGAL PUMP

[76] Inventor: Franz Klaus, Uhland Strasse 54, 463 Bochum, Fed. Rep. of Germany

[21] Appl. No.: 710,929

[22] Filed: Aug. 2, 1976

[30] Foreign Application Priority Data

Aug. 4, 1975 [DE] Fed. Rep. of Germany ..... 2534740

[51] Int. Cl.[2] ..... F04B 17/00

[52] U.S. Cl. ..... 417/420; 64/28 M; 192/84 PM; 310/156; 277/DIG. 6; 415/198.1; 415/214; 415/DIG. 5

[58] Field of Search ..... 415/198 R, 212 R, 212 A, 415/214, DIG. 5; 277/DIG. 6; 417/410, 420; 310/104, 154, 156; 192/84 PM; 64/28 M

[56] References Cited

U.S. PATENT DOCUMENTS

| | | | |
|---|---|---|---|
| 2,048,161 | 7/1936 | Klaiber | 310/154 |
| 2,107,260 | 2/1938 | Ihara | 415/214 |
| 3,194,165 | 7/1965 | Sorlin | 310/104 |
| 3,237,034 | 2/1966 | Krasnow | 310/156 |
| 3,238,878 | 3/1966 | Martin | 417/420 |
| 3,249,780 | 5/1966 | Ibrahim et al. | 310/154 |
| 3,304,875 | 2/1967 | Copeland | 415/214 |
| 3,390,291 | 6/1968 | Eberline et al. | 310/156 |
| 3,551,067 | 12/1970 | Wissman | 415/214 |
| 3,576,380 | 4/1971 | Sargeant | 415/214 |
| 3,647,314 | 3/1972 | Laessig | 417/420 |
| 3,802,804 | 4/1974 | Zimmermann | 417/420 |
| 3,932,068 | 1/1976 | Zimmermann | 417/420 |

*Primary Examiner*—C. J. Husar
*Attorney, Agent, or Firm*—Dressler, Goldsmith, Clement, Gordon & Shore, Ltd.

[57] ABSTRACT

A glandless permanent magnetic centrifugal pump designed for a power input of about 10kW or more and a delivery head of between 2 and 10 bars having a pump casing containing an impeller assembly connected to an inner rotor journalled in the pump casing and carrying permanent bar magnets disposed parallel to the rotor axis via which it is driven magnetically by an outer motor-driven rotor generating a rotating magnetic field passing through an air gap which circumferentially surrounds the inner rotor and in which a gap tube extends around the inner rotor and is fixed to the pump housing to glandlessly close the interior thereof in a fluid-tight manner. All components which come in direct contact with the pumped fluid, particularly the pump casing, the impeller assembly including its shaft, and the inner rotor, and the gap tube, are made entirely of a temperature — and/or acid-resistant synthetic plastics material, in which the permanent bar magnets of the inner rotor are completely embedded and have trapezoidal cross section, their side faces and end faces are tapered and inclined towards each other in the radially outward direction. Bearing material which imparts the hardness and frictional properties of ordinary bearings to the bearing surfaces is incorporated in the synthetic plastics material forming the bearing surfaces of the bearings of the impeller assembly and inner driven rotor.

8 Claims, 4 Drawing Figures

PERMANENT MAGNETIC CENTRIFUGAL PUMP

BACKGROUND OF THE INVENTION

This invention relates to magnetically-driven centrifugal pumps of the glandless kind (referred to herein as "permanent magnet centrifugal pumps") having a pump casing containing an impeller assembly connected to an inner rotor journalled in the pump casing, the inner rotor carrying permanent magnets via which it is driven magnetically by a rotating magnetic field generated by an outer rotor passing through an air gap which circumferentially surrounds the inner rotor, and having a gap tube which extends in the air gap around the inner rotor and is fixed to the pump housing to close the interior thereof in a fluid-tight manner, the inner rotor running in the fluid being pumped and the outer rotor being driven itself by an external motor.

Large high-performance centrifugal pumps which are intended for use in the chemical industry are often required to pump corrosive fluids, to that corrosion protection plays an important part in their construction. Besides using materials that are resistant to attack by specific fluids it is also the practice to make some parts of such pumps, particularly those which come into contact with the pumped fluid, of synthetic plastics materials or to coat them with corrosion-resistant synthetic plastics materials. Especially when the pumps are required in chemical plant to handle toxic and very valuable corrosive media, a seamless type of corrosion protection is particularly desirable. The employment of synthetic plastics materials therefore suggests itself readily. Hitherto-known large pumps needing high input torques in which synthetic plastics are used for corrosion protection are constructed in detail on more or less the same lines as conventional pumps made of metal working materials, particularly of steel, non-ferrous metals, or fine steel. This implies that different kinds of materials must often be combined. For example in the majority of pumps the shaft is still made of metal, particularly steel, even if this shaft is protected in the region where it would otherwise come into contact with the pumped medium by a protective sleeve. Nevertheless, the risk of corrosion is still high in the region where the shaft projects from its seal, assuming that the seal is a gland or a sliding ring seal. In order to eliminate such seals it is therefore often preferred to use glandless pumps to enable the increasingly stringent demands of chemical works as regards freedom from leakage to be met.

High performance glandless pumps for the chemical industries, which are made entirely of synthetic plastics materials, could not in the past be produced satifactorily because the size of the pump gave rise to particular problems, bearing in mind that chemical centrifugal pumps frequently require a power input of about 5 kW, and some as much as 100kW and even more. Fractional horse power pumps such as those used in washing machines and dishwashers and in small chemical apparatus have power inputs of only about 0.1 to 0.5 kW, and these could therefore readily be made entirely of synthetic plastics with embedded permanent or ring or disc magnets.

Glandless centrifugal pumps for chemical applications are characterized more particularly by their axial and radial bearings being lubricated by the pumped medium.

In glandless centrifugal pumps for chemical uses containing a gap tube, the rear part of the shaft driving the impeller wheel of the pump carries an inner driven rotor, which is enclosed in cylindrical sleeve provided with a closed end and herein referred to as the "gap tube." Two forms of construction can be distinguished. In one of these, known as a gap tube motor pump, the drive is basically an induction motor, the inner driven rotor being a squirrelcage rotor which is driven by a rotating field electrically generated by a motor stator. In the other form of construction the motor stator for generating the rotating field is replaced by a system of permanent magnets attached to an outer rotor which produce the magnetic field for imparting rotation to an inner rotor which carries permanent magnets cooperating with the outer permanent magnets the outer rotor itself being driven by an external motor. In this latter form of construction, which is referred to as a permanent magnet pump, the permanent magnets are provided in axial parallelism on either side of the cylindrical part of the gap tube. Both the above forms of construction may be vertically or horizontally mounted. In either case the inner rotor and the impeller assembly with its shaft must run in and be supported by bearings which are lubricated by the pumped medium.

SUMMARY OF THE INVENTION

It is an object of the present invention to provide a high performance glandless permanent magnet centrifugal pump for chemical applications or the like, of a size requiring an input power of about 10kW or more and delivering a working head of about 2 to 10 bars, and which is designed so that it is reliably protected against corrosion without additional complications and increased manufacturing cost.

According to the present invention, a permanent magnet centrifugal pump of the kind specified, which is designed for a power input of about 10kW or more and a delivery head of between 2 and 10 bars, has all its components which are in direct contact with the pumped fluid, particularly the pump casing, the impeller assembly including its shaft, and the inner driven rotor, and the gap tube, made entirely of a temperature-and/or acid-resistant synthetic plastics materal; and the permanent magnets of the inner rotor are bar magnets of trapezoidal cross-section which are completely embedded in the inner rotor in dispositions parallel to the rotor axis, and their side faces and end faces are tapered and inclined towards each other in the radially outward direction; and bearing material which imparts the hardness and frictional properties of ordinary bearings to the bearing surfaces is incorporated in the synthetic plastics material forming the bearing surfaces of the bearings of the impeller assembly and inner driven rotor.

It is preferred to incorporate graphite and/or molybdenum disulphide in the synthetic plastics material forming the bearing surfaces. According to another preferred feature of the invention it is proposed, for the purposes of avoiding the use of all foreign materials in the region of the parts that are wetted by the pumped medium, to provide the radial surfaces at the joints where the parts of the pump casing (intake, volute rings, volute ring and delivery branch and so forth) abut and are pulled tightly together by tiebolts, with a sealing layer of lower hardness than that of the material elsewhere which is a coating of softer synthetic plastic material applied to one of the abutting surfaces after curing of the respective parts.

The invention permits all those structural parts of a large-size permanent magnet centrifugal pump which are contacted by the pumped fluid in use, to be made in their entirety of synthetic plastics, since the special problems that result from the use of synthetic plastics are solved in a way which does not require the use of conventional materials for the bearings, the fixation and location of the permanent magnets and the design of the gap tube. Surprisingly it has been found that in centrifugal pumps of the kind specified provided with axially-parallel driven bar magnets, a design based exclusively on the use of synthetic plastics materials is also possible in the construction of high performance pumps. In conventional centrifugal motor pumps using a gap tube the provision of an extremely thin metal sleeve for the purpose of sealingly separating the outer stator from the inner rotor could not be dispensed with.

In a pump according to the invention, notwithstanding the generation of high centrifugal forces the permanent magnets are reliably located. The gap tube may take the form of a body freely located in space exclusively by means of a fixing flange at its open end gripped between the flange of a pump pedestal (e.g. the stator casing) and the pump casing. In order to avoid the need for individual magnets of excessive size when the driving torques are very high, it is desirable to embed the permanent magnets of the inner driven rotor end-to-end in the rotor. In other words, it is proposed to divide each permanent magnet of the inner rotor into several magnets arranged end-to-end.

At high input torques, particularly for power inputs of 30kW and more, the diameter of the gap tube must be very large and its wall thickness considerable, particularly when the delivery heads are also high, say 5 to 10 bars. In order to avoid the gap tube having an unduly thick wall and magnetic losses being too high, it is proposed according to another optional feature of the invention to provide the cylindrical part of the gap tube with a peripheral binding of high-strength plastics tape or filaments which are shrunk after having been laid on, in order to prestress the cylindrical portion in circumferential compression.

For the production of the pump several different kinds of synthetic plastics materials are suitable, notably those which are both temperature resistant up to 200° C. and resistant to attack by about 80% of all media usually required to be pumped, besides having satisfactory mechanical properties. Synthetic plastics materials which comply with this specification will be readily known to a skilled person familiar with synthetic plastics working material.

BRIEF DESCRIPTION OF THE DRAWINGS

The invention may be carried into practice in various ways, but one specific embodiment of the invention and certain modifications thereof will now be described by way of example only and with reference to the accompanying drawings in which.

DESCRIPTION OF THE PREFERRED EMBODIMENTS

Figure 1:
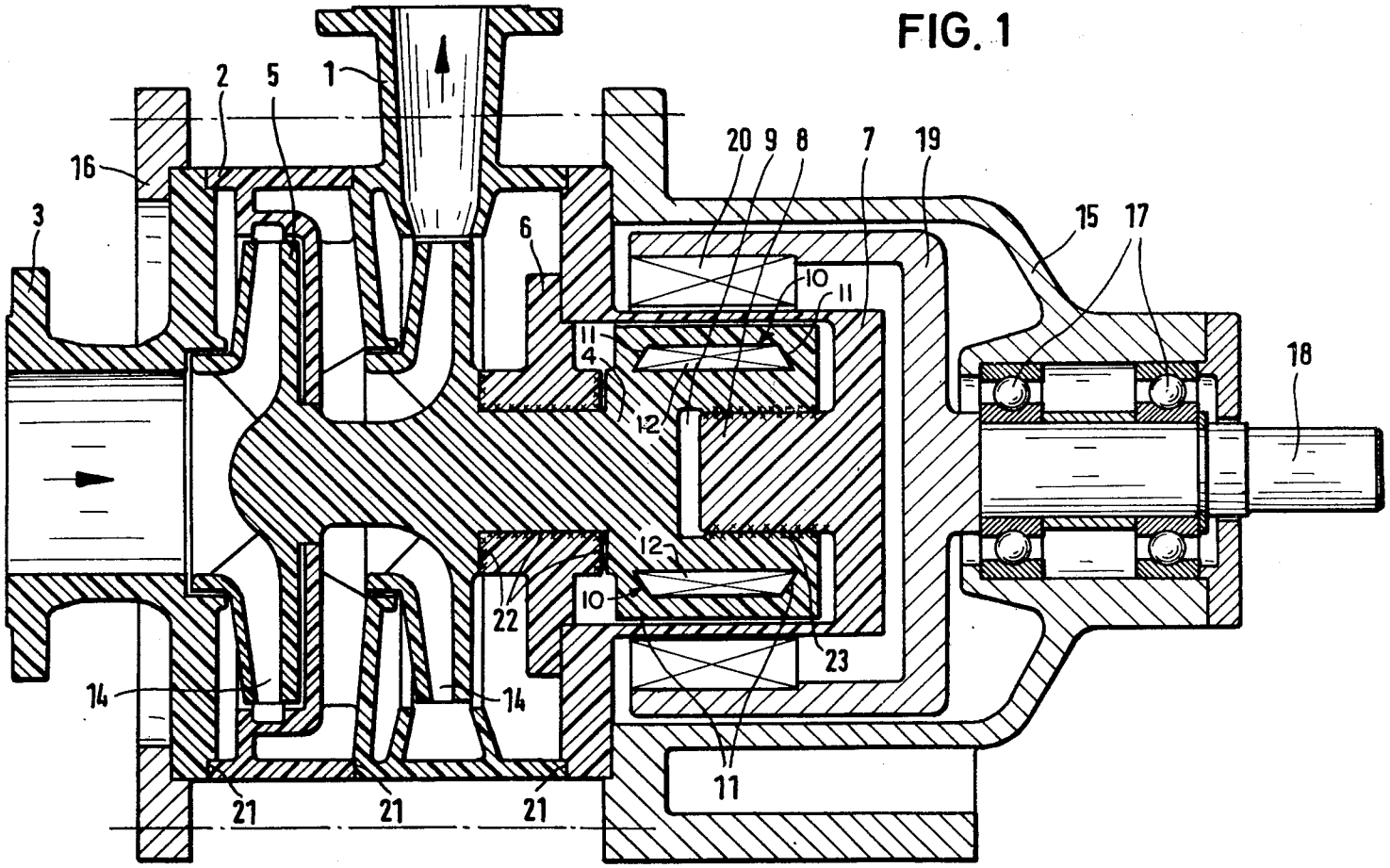
FIG. 1 is a longitudinal section of a permanent magnet centrifugal pump.
Figure 2:
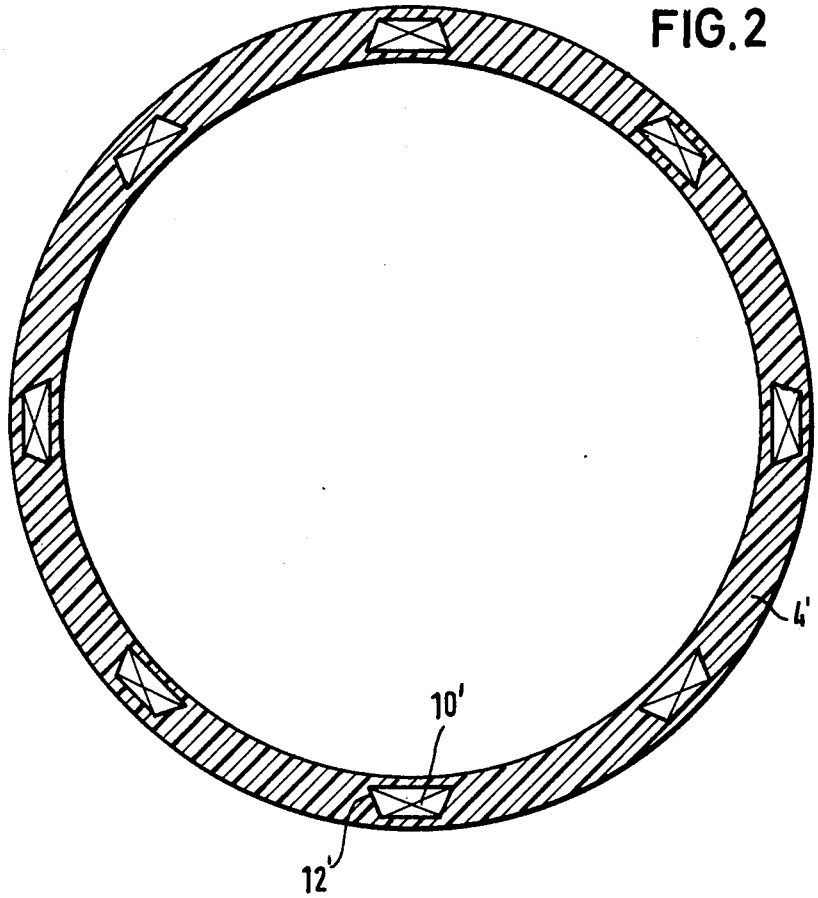
FIG. 2 is an enlarged cross-sectional view of another embodiment of an inner driven rotor made of synthetic plastics, of different dimensions than the inner driven rotor of FIG. 1.
Figure 3:
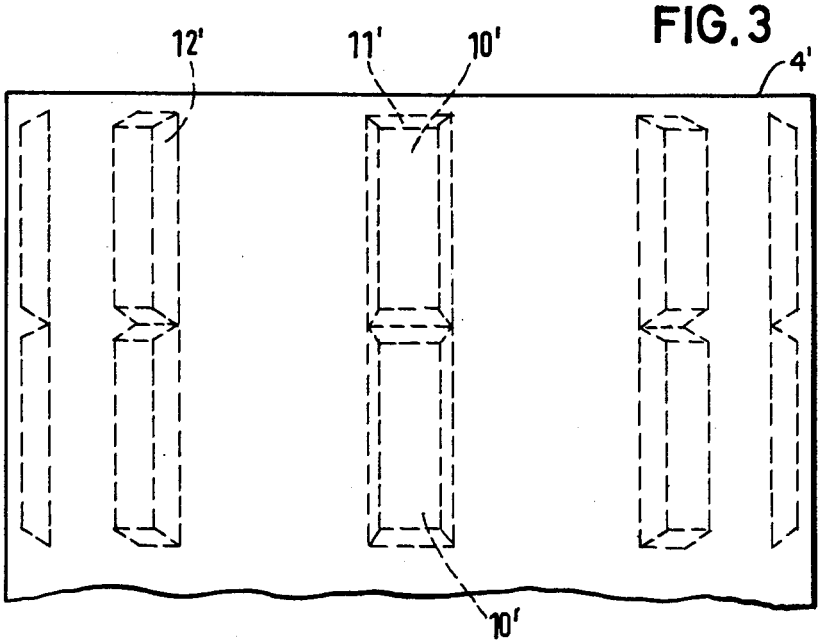
FIG. 3 is a side elevational view of the disposition of the magnets in the rotor in FIG. 2, the arrangement comprising permanent magnets placed end-to-end and parallel to the rotor axis.

The magnetically-driven pump shown in FIG. 1 is of the two-stage type. The pump casing which is in contact with the pumped fluid consists of a volute ring 1 embracing the second stage and providing the delivery outlet of the pump, a further volute ring 2 embracing the first stage, and an axial intake 3. A gap tube or separation tube 7 is provided at the pressure end of the pump casing. This gap tube is formed centrally in its interior with a pintle 8. The pump casing contains a one-piece rotor 5 which at its front end forms two centrifugal impellers 14. The rear end of the rotor 5 is extended to form an inner driven rotor 4 provided with an axial bearing recess 9 for the reception therein of the pintle 8 of the gap tube 7. Axially-disposed permanent bar magnets 10, each having a trapezoid-shaped cross section, are completely embedded in the plastic material of the inner driven rotor 4. In an alternate embodiment illustrated in FIGS. 2 and 3, two circumferential rows of axially-disposed permanent bar magnets 10' of trapezoid-shaped cross section, are completely embedded in the plastics material of a similar inner driven rotor 4'. In both embodiments, the magnets are so designed that their bevelled end and side faces (11 and 12, respectively, for the embodiment illustrated in FIGS. 1, and 11' and 12', respectively, for the embodiment illustrated in FIGS. 2 and 3) taper towards the outside. Besides being journalled on the pintle 8 which projects from the bottom of the gap tube 7 the driven rotor runs in a split bearing ring 6 attached to the end face of the gap tube 7. At the split bearing ring 6 and the pintle 8 in the gap tube 7 the cooperating bearing surfaces 22 of the bearing ring 6 and of the inner driven rotor 4, and the bearing surfaces 23 of the pintle 8 and of the cooperating part of the inner driven rotor 4, contain graphite or molybdenum disulphide incorporated in the material, as indicated in the drawing by small crosses.

The parts 1, 2 and 3 of the casing as well as the gap tube 7 have radial abutting faces 21. Whereas conventionally sealing rings would be provided for these joints, the illustrated embodiment provides at these abutting faces sealing surface layers which are not as hard as the main parts of the abutting members. The provision of seals can thus be dispensed with, the functions of sealing rings being performed by the layers of reduced hardness.

Figure 4:
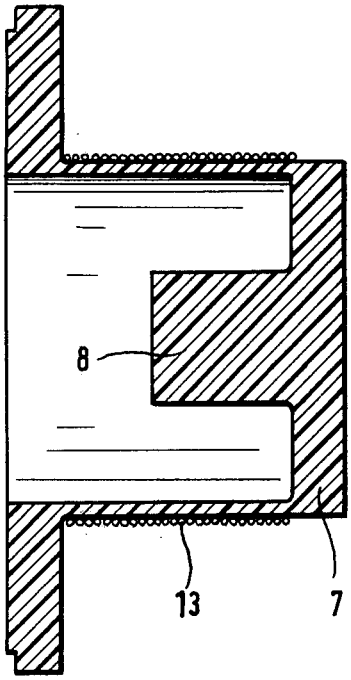
FIG. 4 is a longitudinal section of a modified construction of the gap tube shown in FIG. 1 which on its cylidrical exterior is provided with a plastics tape binding and compressively prestressed.

The parts 1, 2 and 3 of the casing, as well as the gap tube 7, which are all made of synthetic plastics material in the same way as the driven rotor 4, the impeller rotor 5 and the bearing ring 6, are all supported by a pedestal 15 which contains bearings 17 for the drive shaft 18 of an outer rotor 19 which contains axially-disposed permanent driving magnets 20. The parts of the casing are pulled tight against the terminal flange of the pedestal 15 by tiebolts, not shown, which extend between said flange and a ring flange 16 bearing against the intake part 3 of the casing. The The outer rotor, pedestal and ring flange need not consist of a corrosion-resistant material. It is preferred in conventional manner to make them of metal. However, the characteristic feature of the proposed pump is that every part that comes into contact with the pumped fluid is made of a synthetic plastics material. The bearings of the inner driven rotor are lubricated by the pumped liquid as is conventional. For this purpose a duct system not shown in the drawing is provided which extends from the pressure side of the second impeller 14 to the bearings and the gap between the inner driven rotor 4 and the gap tube 7. The inner driven rotor 4 can, as illustrated, run on the pintle 8 inside the gap tube 7 because the wall of the cylindrical portion of the gap tube can be made sufficiently thick without thereby causing unacceptable magnetic transmission losses in the gap between the inner and the outer rotors. If the torques and pressure heads are high the external cylindrical surface of the gap tube 7, as illustrated in FIG. 4, may be reinforced with a binding consisting of at least one layer of thermally shrunk plastics tape 13 which have been laid on under tension. This results in the gap tube 7 being compressively prestressed in its normal state and capable of sustaining greater internal radial loads notwithstanding a relatively thin wall. Moreover, the magnetic losses in the gap are also low.

The bearing materials are incorporated in the bearings either during the moulding process of the parts by first placing a layer consisting of a mixture of bearing material and plastics into the mould and then introducing the main mass of the plastics, possibly after the initial layer has partly cured or set, or alternatively by first introducing only a layer of bearing material in the region where the bearings are to be formed and then only a bonding agent, in which case the bearing material will penetrate the plastics to a sufficient depth.

I claim:

1. A high power, high pressure permanent magnet centrifugal pump having an impeller driving inner rotor with a plurality of individual permanent bar magnets associated therewith in which all components which are in direct contact with the pumped fluid, particularly the pump casing, the impeller assembly including its shaft, and the inner rotor, and the gap tube, are made entirely of a synthetic plastics material, in which the permanent magnets of the inner rotor are bar magnets of trapezoidal cross-section which are completely embedded in the inner rotor in dispostions parallel to the rotor axis, and their side faces and end faces are tapered and inclined towards each other in the radially outward direction, and in which bearing material which imparts the hardness and frictional properties of ordinary bearings to the bearing surfaces is incorporated in the synthetic plastics material forming the bearing surfaces of the bearings of the impeller assembly and inner driven rotor.

2. A permanent magnetic centrifugal pump according to claim 1, in which said bearing surfaces are generally cylindrical and are disposed about a longitudinal axis concident with the axis of said inner rotor and in which one of graphite and molybdenum disulphide is embedded in said bearing surfaces.

3. A permanent magnet centrifugal pump according to claim 1 in which abutting synthetic plastics parts of the pump casing are provided with a sealing layer of lower hardness where they abut at the joints of the pump casing.

4. A permanent magnetic centrifugal pump according to claim 1, in which the permanent bar magnets embedded in the inner driven rotor comprise axially-parallel groups of magnets each having at least two magnets embedded end-to-end.

5. A permanent magnetic centrifugal pump according to claim 1 in which the gap tube is held in position exclusively by a terminal flange which is gripped between the pump casing and a pump pedestal.

6. A permanent magnetic centrifugal pump according to claim 1 in which the gap tube has a generally cylindrical exterior surface and has a peripheral binding of high-strength plastic filaments which have been shrunk after they have been laid on said surface whereby the cylindrical part of the gap tube is pre-tested in circumferential compression.

7. A high power, high pressure permanent magnet centrifugal pump in which all components which are in direct contact with the pumped fluid, particularly the pump casing, the impeller assembly including its shaft, and the inner rotor, and the gap tube, are made entirely of a synthetic plastics material, said pump having axially-parallel groups of permanent bar magnets completely embedded in the inner rotor in dispositions parallel to the rotor axis, each group having at least two bar magnets embedded end-to-end, said bar magnets having a trapezoidal cross section with their side faces and end faces tapered and inclined towards each other in the radially outward direction, said pump further having synthetic plastics material forming the bearing surfaces of the bearings of the impeller assembly and inner driven rotor, said bearing surfaces having one of grahite and molybdenum disulphide embedded therein, the abutting synthetic plastics parts of the pump casing having a sealing layer of lower hardness where they abut at the joints of the pump casing, said gap tube being held in position exclusively by a terminal flange which is gripped between the pump casing and a pump pedestal.

8. A permanent magnet centrifugal pump according to claim 7 in which the gap tube has a generally cylindrical exterior surface and has a peripheral binding of high-strength plastic filaments which have been shrunk after they have been laid on said surface whereby the cylindrical part of the gap tube is pre-stressed in circumferential compression.

* * * * *

UNITED STATES PATENT AND TRADEMARK OFFICE

CERTIFICATE OF CORRECTION

PATENT NO. : 4,120,618

DATED : October 17, 1978

INVENTOR(S) : Franz Klaus

It is certified that error appears in the above–identified patent and that said Letters Patent are hereby corrected as shown below:

Column 4, line 3: "cylidrical" should be --cylindrical--.

Column 5, line 16: "tape" should be --tapes--.

Column 5, line 54: "concident" should be --coincident--.

Column 6, line 22: "pre-tested" should be --pre-stressed--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*